US012806507B2

(12) United States Patent
Fitzpatrick

(10) Patent No.: US 12,806,507 B2
(45) Date of Patent: Nov. 24, 2026

(54) PROBABILITY-BASED GAME AND METHOD OF PLAY

(71) Applicant: William Fitzpatrick, Orchard Park, NY (US)

(72) Inventor: William Fitzpatrick, Orchard Park, NY (US)

( * ) Notice: Subject to any disclaimer, the term of this patent is extended or adjusted under 35 U.S.C. 154(b) by 271 days.

(21) Appl. No.: 18/654,587

(22) Filed: May 3, 2024

(65) Prior Publication Data

US 2025/0339762 A1 Nov. 6, 2025

(51) Int. Cl.
*A63F 3/00* (2006.01)
*A63F 1/04* (2006.01)

(52) U.S. Cl.
CPC ..... *A63F 3/00* (2013.01); *A63F 1/04* (2013.01); *A63F 3/00063* (2013.01); *A63F 2003/00996* (2013.01)

(58) Field of Classification Search
CPC ..... A63F 1/04; A63F 3/00; A63F 3/00063; A63F 3/00006
USPC ..... 273/236, 242, 243, 248, 275, 287
See application file for complete search history.

(56) References Cited

U.S. PATENT DOCUMENTS 4,027,882 A 6/1977 Rosenberg
4,515,369 A * 5/1985 Johnson ..... A63F 9/0402 273/243
4,729,568 A 3/1988 Bailey
5,163,687 A 11/1992 Jenkins
5,318,304 A 6/1994 Reppas
7,232,128 B2 6/2007 Laporte
9,999,829 B1 * 6/2018 Fechser ..... A63F 7/02
2006/0261551 A1 11/2006 Laporte
2007/0013129 A1 1/2007 Laporte
2007/0013130 A1 1/2007 Laporte
2009/0039601 A1 2/2009 Carpe

FOREIGN PATENT DOCUMENTS

GB 2051590 A 1/1981

* cited by examiner

*Primary Examiner* — Thomas M Sember
(74) *Attorney, Agent, or Firm* — Simpson & Simpson, PLLC

(57) ABSTRACT

A board game and associated method for using the game board having a logical game structure, that in the representative embodiment taps into the emotional attraction of the sports draft combine. The game board has indicia representing an area of play and indicating sections including 1) a bust section, 2) a start section adjacent to the bust section, 3) a finish section, and 4) a movement section arranged between and adjacent to the start section and the finish section having a plurality of game piece movement positions, the plurality of game piece movement positions arranged on a plurality of pathways along the length of the area of play, each of the plurality of pathways having a pathway number and one or more game piece movement positions. The board game includes a plurality of game pieces wherein movement is at least partially determined by rolling one or more dice.

19 Claims, 6 Drawing Sheets

| DICE ROLL | COMBINATIONS REQUIRED | % |
|---|---|---|
| 2 |  | 2.78 |
| 3 |  | 5.56 |
| 4 |  | 8.33 |
| 5 |  | 11.11 |
| 6 |  | 13.89 |
| 7 |  | 16.66 |
| 8 |  | 13.89 |
| 9 |  | 11.11 |
| 10 |  | 8.33 |
| 11 |  | 5.56 |
| 12 |  | 2.78 |

PROBABILITY-BASED GAME AND METHOD OF PLAY

FIELD OF THE INVENTION

The present disclosure generally relates to a game, particularly a probability-based game having a playing board, and also to a method of playing the same.

BACKGROUND

Any game that has a definable winner can serve as a game for betting. At a minimum, people can bet on who will be the winner. Such game may have a game board. Board games that can be used as betting games have a rich history spanning cultures and eras. They combine the strategic depth of traditional board games with the thrill of gambling, making for an engaging and competitive experience. From classics like chess and backgammon to modern favorites such as poker and Monopoly, these games offer a diverse range of options for players looking to test their skills and luck while wagering bets.

An important aspect of board games when used as betting games is the balance between strategy and chance. While skillful play can certainly increase one's chances of winning, luck often plays a significant role, adding an element of unpredictability and excitement to each match. This dynamic nature attracts players of all levels, from casual enthusiasts to seasoned professionals.

In addition to the inherent enjoyment of playing, betting adds another layer of excitement and incentive. Whether playing for small stakes among friends or competing in high-stakes tournaments, the prospect of winning or losing money heightens the intensity of each move and decision. This can lead to tense moments, dramatic comebacks, and thrilling victories, making for memorable experiences both on and off the board.

Furthermore, the social aspect of board games used as betting games cannot be overstated. They bring people together, fostering camaraderie, friendly competition, and shared memories. Whether gathered around a table at home, in a bustling casino, or at a tournament venue, players bond over their shared love of the game and the shared risk of the bet.

Board games, at least tacitly, often relate to real world events. One real world event is watching sports draft combines, an exhilarating experience for many, as it offers a firsthand glimpse into the raw talent and potential of aspiring athletes vying for positions in professional sports leagues. The anticipation builds as spectators witness athletes undergo rigorous physical tests, demonstrating their speed, strength, agility, and skill under the scrutiny of coaches, scouts, and fans alike. Each performance can be a make-or-break moment for athletes, as their futures hang in the balance, adding an element of suspense and excitement to every drill and measurement. For fans, observing these showcases provides a thrilling opportunity to speculate on which players will rise to the top and potentially shape the future of their favorite teams, making draft combines a captivating spectacle that captures the imagination of sports enthusiasts worldwide. People may bet on the outcomes of the combines.

Related to the above, there is an ongoing demand, i.e., a long-felt need, on the market for improved games to provide variety and new experiences. New games can combine logic behind a game's mechanics, where mathematical certainty and randomness set logical frameworks for an enjoyable game, and emotion, where game creators can tap into an appealing psychological framework for individual real and fantasy identities.

SUMMARY OF THE INVENTION

Disclosed is a board game and an associated method for using the board game having a logical game structure, and that in the representative embodiment taps into an emotional attraction of a sports draft combine. A game board has a proximal end and a distal end. The game board also has indicia, the indicia representing an area of play having a length and a width and indicating sections including 1) a bust section at the proximal end of the game board, the bust section having a plurality of game piece bust positions arranged in at least one bust row, the at least one bust row substantially the width of the area of play; 2) a start section adjacent to the bust section having a plurality of game piece start positions arranged in a start row, the start row substantially the width of the area of play; 3) a finish section arranged at the distal end of the game board and having a plurality of game piece finish positions arranged in a finish row, the finish row substantially the width of the area of play; 4) a movement section arranged between and adjacent to the start section and the finish section having a plurality of game piece movement positions, the plurality of game piece movement positions arranged on a plurality of pathways along the length of the area of play, each of the plurality of pathways having a pathway number and one or more game piece movement positions. The board game includes a plurality of game pieces designed to be moved on the area of play, movement at least partially determined by one or more dice, each game piece of the plurality of game pieces associated with a game piece number equal to and representing a pathway number that can appear on a roll of the one or more dice.

Additional, or secondary, indicia may be included within the aforementioned areas within the area of play which may indicate multipliers, progressions, and/or values related to using the board game.

In some embodiments of the game board, the bust section, the start section, the movement section, and the finish section each have a different color from adjacent sections.

In some embodiments of the game board, the number of game piece movement positions on each pathway of the plurality of pathways is determined by the probability of rolling the pathway number on the one or more dice. Some embodiments of the game board include two six-sided dice.

In some embodiments of the game board, each game piece number corresponds to a player card having a player card number equal to and representing the game piece number.

In some embodiments of the game board, at least the indicia and the game pieces are presented and controllable on at least one computer interface of at least one computer.

In some embodiments of the game board, at least the indicia and the game pieces are presented as physical elements of at least one or more from a group comprising of cellulose materials, polymer materials, metallic materials, and ceramic materials. In some embodiments of the game board, the game pieces are pegs.

One method for using the board game includes placing game pieces of a plurality of game pieces by users on a starting row of a start section the width of a playing area of a game board wherein each game piece of the plurality of game pieces is aligned with a pathway of a movement section adjacent to the start section, each pathway along the length of the playing area and having a pathway number, each game piece given a game piece number equal to the pathway number aligned with that game piece on the starting row. The method further includes rolling the one or more dice one or more times to determine each game piece of the plurality of game pieces that will move proximally from the starting row to a bust section adjacent to the start section, and then moving those game pieces. The method further includes rolling the one or more dice one or more times to determine each game piece of the plurality of game pieces that will move distally from the starting row into a movement section and toward a finish section adjacent to the movement section, and then moving those game pieces. The method further includes exchanging between rolling dice one or more game piece numbers between users. The method further includes moving by stages, determined by rolling the one or more dice one or more times, at least one game piece from the movement section until one game piece of the at least one game pieces reaches and is moved into the finish section.

The method may further include rolling two dice on each roll of the dice when determining game piece movement.

The method may further include calculating a score from at least one or more of moving at least one game piece into the finish section and a value indicated by at least one value indicator card associated with the at least one game piece.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION OF THE INVENTION

Figure 1:
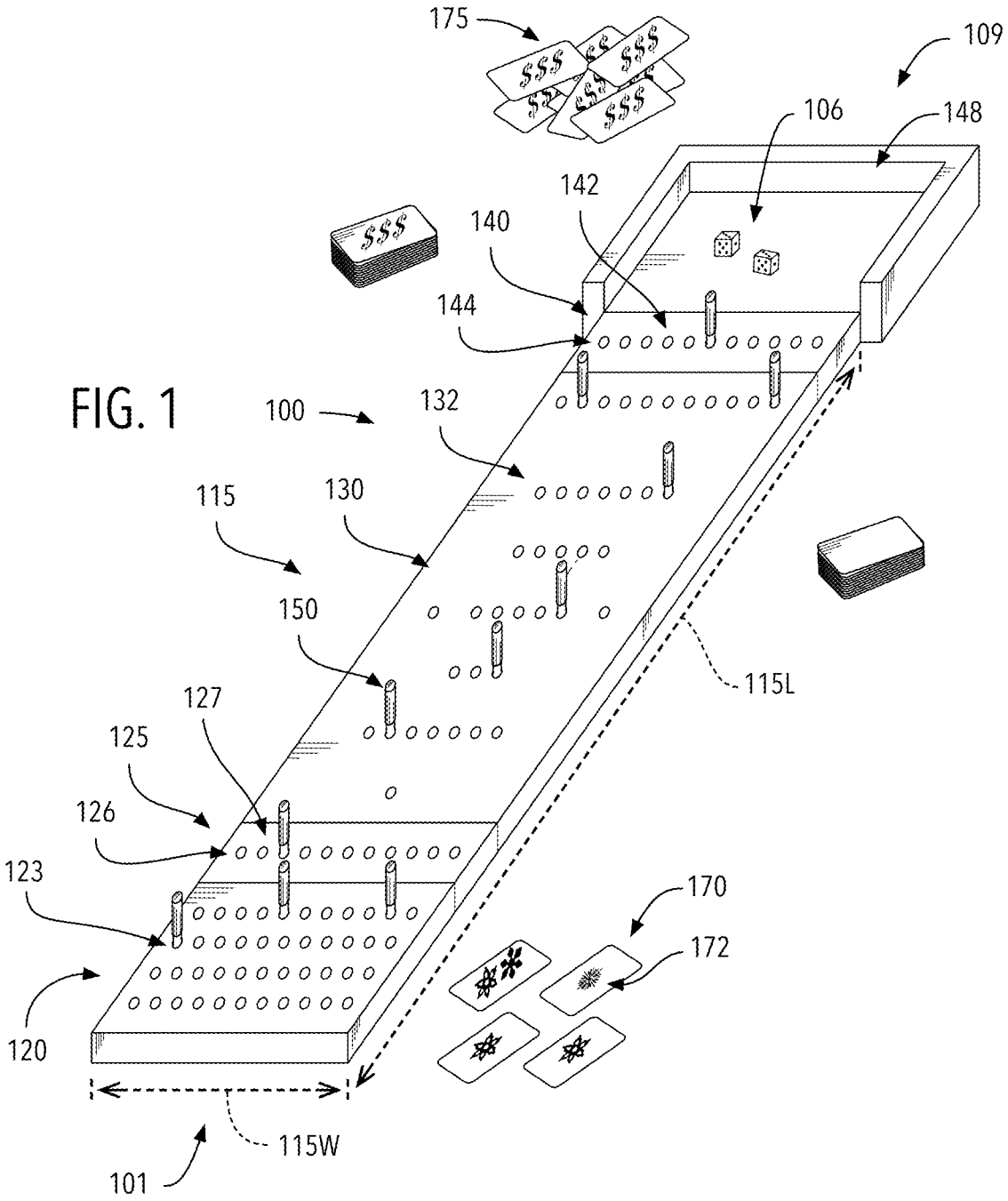
FIG. 1 illustrates a perspective view of a game disclosed herein, specifically a perspective view of the representative game board along with game pieces, player cards, value indicator cards, and dice.

Following are detailed descriptions of various related concepts related to, and embodiments of, methods and apparatus according to the present disclosure. It should, however, be understood that this disclosure is not limited to the particular methodology, materials, and modifications described and, as such, may, of course, vary. It is also understood that the terminology used herein is for the purpose of describing particular aspects only and is not intended to limit the scope of the claims.

Furthermore, it should be appreciated that drawings are representative to illustrate the inventive concepts herein and may not be to scale. Also, like drawing numbers on different drawing views identify identical, or functionally similar, structural elements where there could appear some variations on exactness where exactness is not material to the inventive concept herein. For illustration, the type of head on a helically threaded connector could differ on like identified items when the importance is that the identified item is a helically threaded connector, and other items could be treated similarly. It is to be understood that the claims are not limited to the disclosed aspects. In the disclosed invention, for further illustration, game pieces may have many designs such as designs to appear as sports figures and may have other designs such as simple tokens without materially affecting the invention disclosed.

Unless defined otherwise, all technical and scientific terms used herein have the same meaning as commonly understood to one of ordinary skill in the art to which this disclosure pertains. It should be understood that any methods, devices, or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. It should be appreciated that the term "distal" and comparably related terms denoting further-away portions of an item are antonymous to proximal portions of the co-described item as those portions of items may be termed. The term "approximately" is intended to mean values within ten percent of the specified value.

It should be understood that the use of "or" in the present application is with respect to a "non-exclusive" arrangement unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B.

Furthermore, as used herein, when referring to a set or group of items, for illustration (A, B, C) the term "at least one or more . . . and . . . " such as in "at least one or more of A, B, and C" is intended to include any to all of the denoted set or group of items, i.e. it could include just one item from the set or group, it could include all of the items from the set or group, and it could include any other combination of the set or group of items that is greater than one item and less than all of the items, the illustrated example having three items meaning there are up to seven non-ordered combinations A, B, C, AB, AC, BC, ABC. Other numbers of items would have maximum combination possibilities calculated accordingly.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein.

Figure 2:
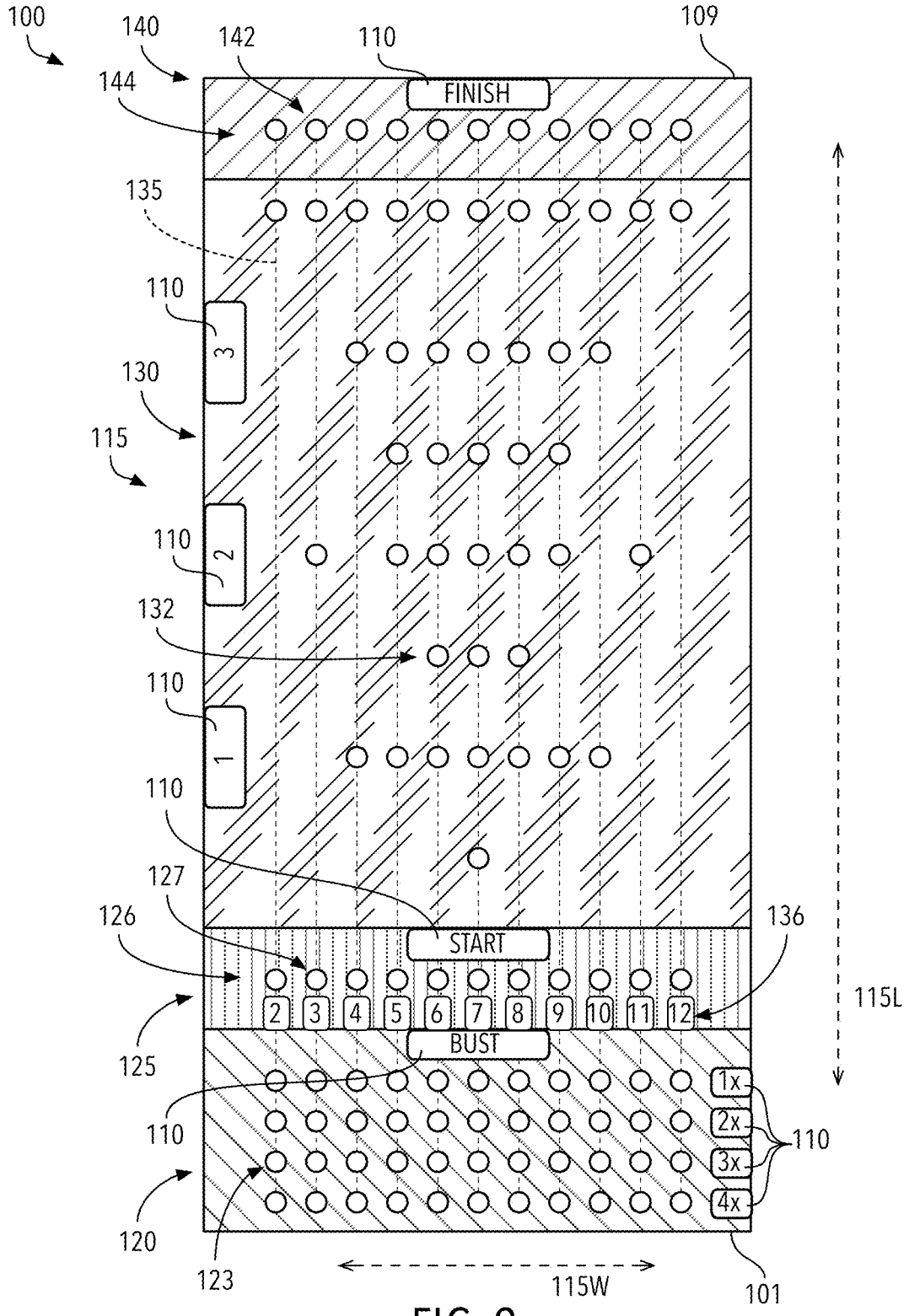
FIG. 2 illustrates a top view of the representative game board of the game shown in FIG. 1.

Disclosed in FIGS. 1 and 2 is a perspective view and a top view of the board game. A game board 100 of the board game has a proximal end 101 and a distal end 109. The game board 100 also has indicia 110, the indicia 110 representing an area of play 115 having a length 115L and a width 115W and indicating sections, the sections including 1) a bust section 120 at the proximal end of the game board 101, the bust section 120 having a plurality of game piece bust positions 123 arranged in at least one bust row, the at least one bust row substantially the width of the area of play 115W; 2) a start section 125 adjacent to the bust section 120 having a plurality of game piece start positions 127 arranged in a start row 126, the start row 126 substantially the width of the area of play 115W; 3) a finish section 140 arranged at the distal end (proximate to) of the game board 109 and having a plurality of game piece finish positions 142 arranged in a finish row 144, the finish row 144 substantially the width of the area of play 115W; and 4) a movement section 130 arranged between and adjacent to the start section 125 and the finish section 140. The movement section 130 having a plurality of the game piece movement positions 132, the plurality of game piece movement positions 132 arranged on a plurality of pathways 135 along the length of the area of play 115L, each of the plurality of pathways 135 having a pathway number 136 and one or more game piece movement positions 132. The board game includes a plurality of game pieces 150 designed to be moved on the area of play 115, movement at least partially determined by one or more dice 160, each game piece 150 of the plurality of game pieces 150 associated with a game piece number 152 equal to and representing a pathway number 136 that can appear on a roll of the one or more dice 160.

The illustrated game board 100 in FIGS. 1 and 2 is a representative embodiment of the board game. The bust section 120 has eleven game piece bust positions 123 arranged in four bust rows, the four bust rows substantially the width of the area of play 115W. The start section 125 has eleven game-piece start position 127 arranged in the start row 126. The finish section 140 has eleven game piece finish positions 142 arranged in the finish row. The movement section 130 has eleven pathways 135 along the length of the area of play 115L, each of the eleven pathways 135 having the pathway number 136 from two to twelve sequentially and one or more game piece movement positions 132 disposed on each pathway 135 of the eleven pathways 135. The eleven game pieces 150 are designed to be moved on the area of play 115, movement at least partially determined by two dice 160, the dice 160 designed to be rolled together, each game piece 150 of eleven game pieces 150 associated with the game piece number 152 from two to twelve representing the pathway number 136 that can appear on the roll of the two dice 160.

In some embodiments of the game board 100, the bust section 120, the start section 125, the movement section 130, and the finish section 140 each have a different color from adjacent sections. In some embodiments, the board is colored to model an American football playing field.

In some embodiments of the game board 100, the number of game piece movement positions 132 on each pathway 135 of the plurality of pathways 135 is determined by the probability of rolling the pathway number 136 on the one or more dice 160. Some embodiments of the game board 100 include two six-sided dice 160. In one representative embodiment of the game board 100, pathway two and twelve each have one game piece movement position, pathway three and eleven each have two game piece movement positions, pathway four and ten each have three game piece movement positions, pathway five and nine each have four game piece movement positions, pathway six and eight each have six game piece movement positions, and pathway seven has seven game piece movement positions. The game piece movement positions 132 correspond to the probability of rolling given numbers on two dice 160 being a fraction of thirty-six possible ordered pairs of numbers and approximately normalize the probability of game pieces 150 on each pathway 135 reaching the finish section 140 before other game pieces 150.

Figure 3:
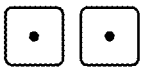
FIG. 3 illustrates a table of dice pair roll odds.
Figure 3:
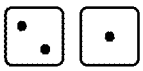
Figure 3:
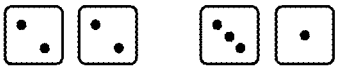
Figure 3:
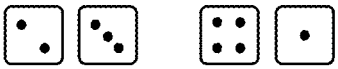
Figure 3:
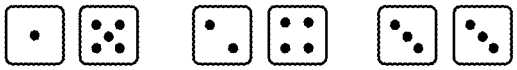
Figure 3:
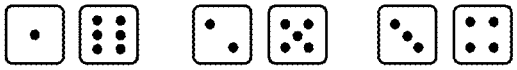
Figure 3:
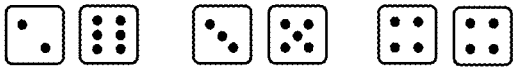
Figure 3:
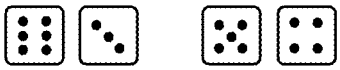
Figure 3:
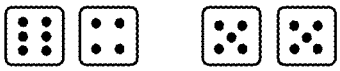
Figure 3:
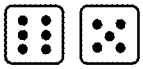
Figure 3:
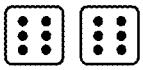

FIG. 3 illustrates the probabilities of rolling given numbers on two dice 160, these being understood probabilities of rolling number pairs {x,y} and summing the total wherein the probability of 2≈0.0278, 3≈0.0556, 4≈0.0833, 5≈0.1111, 6≈0.1389, 7≈0.1666, 8≈0.1389, 9≈0.0833, 10≈0.1111, 11≈0.0556, 12≈0.0278. The probability of outcomes on multiple rolls of the dice 160 can be determined by way of binomial equations of combinatorial mathematics and probability represented by:

$$P(X=k)=\binom{n}{k}\times p^k\times(1-p)^{n-k}$$

P(X=k) in the above equation is the probability of getting exactly k successes (rolling a given number) in n trials (rolls of the dice 160).

$$\binom{n}{k}$$

is the number of combinations of choosing k successes out of n trials.

p is the probability of success on each trial (rolling a given number).

(1−p) is the probability of failure on each trial.

Combinatorial mathematics and associated probability underpin the design of the representative illustration of the board game, and would also underpin variations of the game design to accommodate balancing and unbalancing odds of success for given game pieces 150 and providing further avenues to weigh the value of contracts and outcomes, where contracts equal a unit of value such as money. For illustration, rather than requiring game piece 150 on position seven to travel seven game piece positions 132 to reach the finish row 144, that game piece 150 may only be required to travel some number of game piece positions 132 less than seven. In this way, the invention as disclosed is adapted to include odds of winning for game pieces 150 wherein trading may take place between players for player cards 172.

A further consideration includes the number of rolls of dice 160 made for a given period. For example, while the probability of rolling seven sevens on dice 160 over a period may be comparable to the probability of rolling two once in that seven rolls, the probability of rolling seven sevens in fewer than seven rolls is zero while there remains a probability of rolling a two as long as there is at least one roll. Such can make for interesting negotiations where, for example, players decide whether they prefer better odds for winning over multiple roles of dice 160 or possibly winning in fewer roles of dice 160, and also portfolio strategies where a user may win with greater or fewer roles of dice 160 with one or another player card 170. Other embodiments of the invention may, therefore, include different numbers of game piece movement positions 132 on pathways 135.

In some embodiments of the game board 100, with reference to FIGS. 1 and 2, each game piece number 152 corresponds to a player card 170 having a player card number 172 equal to and representing the game piece number 152. One representative embodiment of the game board 100 includes forty-four of the player cards 170, four of the player cards 170 for each game piece 150. In this representative embodiment of the game board 100 each game piece number 152 corresponds to the player cards 170 having the player card number 172 equal to and representing the game piece number 152.

In some embodiments of the game board 100, at least the indicia 110 and the game pieces 150 are presented and controllable on at least one computer interface of at least one computer. Player cards 170 and value indicator cards 175 may also have virtual representations. As such, the disclosed invention retains its fundamental disclosed aspects along the normal path of technical evolution where the disclosed board game could be entirely mechanical and manually operated; it could have electronic components, such as a casino game variety that might automate tabulation and provide such signals as lights; to an all virtual version, where the disclosed aspects of the board game are substantially the same.

As illustrated in FIG. 1, in some embodiments of the game board 100, at least the indicia 110 and the game pieces 150 are presented as physical elements of at least one or more from a group including: cellulose materials, polymer materials, metallic materials, and ceramic materials. In some embodiments of the game board 100, the game pieces 150 are pegs 150P. One representative embodiment of the game board 100 includes eleven value indicator cards 175 for each user of the game board 100.

Figure 4A:
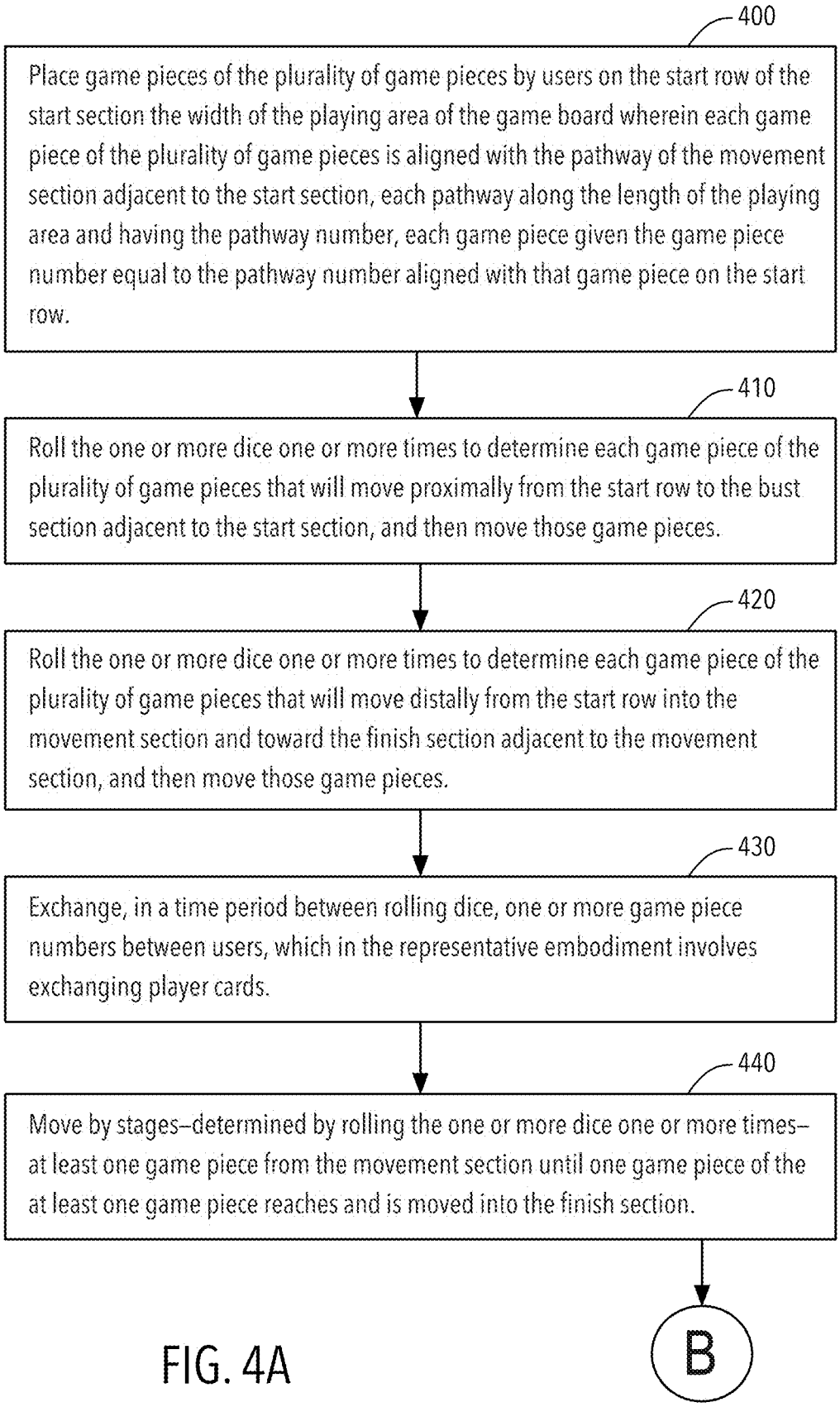
FIGS. 4A and 4B illustrate a representative method for using the representative game board; and, FIG. 5 illustrates a top view of an alternative embodiment of the game board shown in FIG. 2.
Figure 4B:
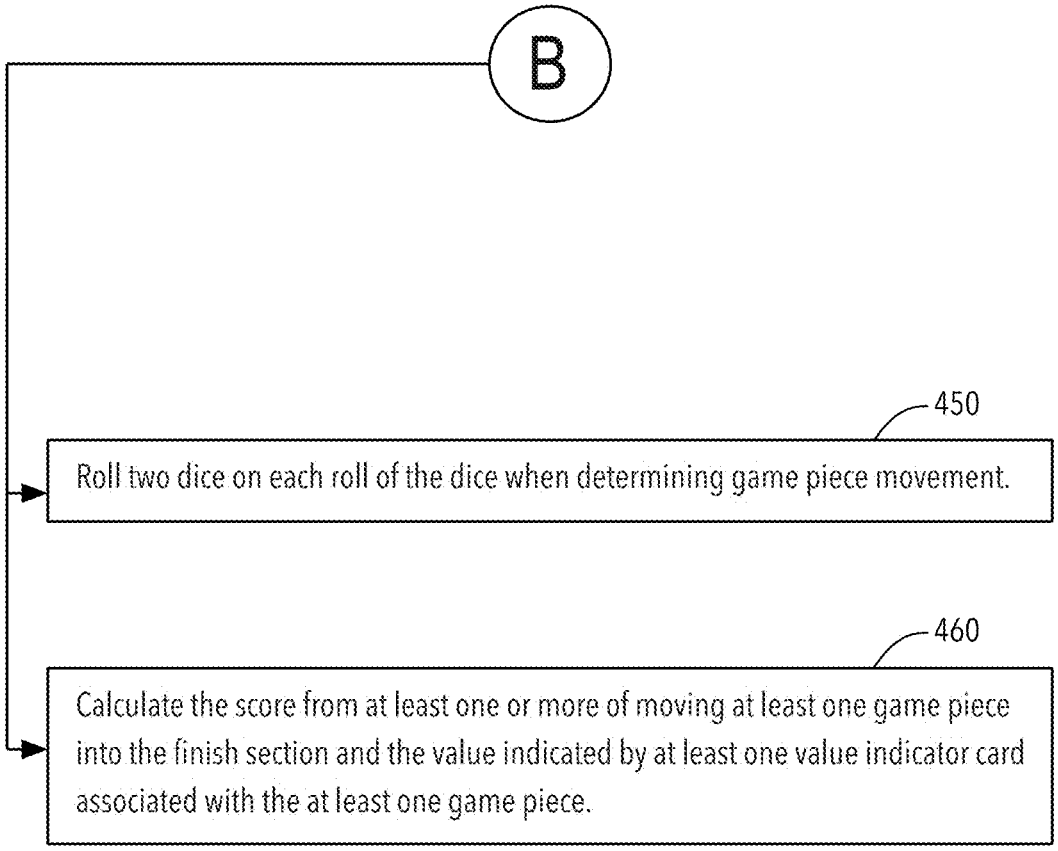

FIGS. 4A and 4B illustrate that the method for using the board game includes the step of 400 placing game pieces 150 of the plurality of game pieces 150 by users on the start row 126 of the start section 125 the width of the playing area of the game board 100 wherein each game piece 150 of the plurality of game pieces 150 is aligned with the pathway 135 of the movement section 130 adjacent to the start section 125, each pathway 135 along the length of the playing area and having the pathway number 136, each game piece 150 given the game piece number 152 equal to the pathway number 136 aligned with that game piece 150 on the start row 126. The method further includes the step of 410, rolling the one or more dice 160 one or more times to determine each game piece 150 of the plurality of game pieces 150 that will move proximally from the start row 126 to the bust section 120 adjacent to the start section 125, and then moving those game pieces 150. The method further includes the step of 420, rolling the one or more dice 160 one or more times to determine each game piece 150 of the plurality of game pieces 150 that will move distally from the start row 126 into the movement section 130 and toward the finish section 140 adjacent to the movement section 130, and then moving those game pieces 150. The method further includes the step of 430, exchanging, in a time period between rolling dice 160, one or more game piece numbers 152 between users, which in the representative embodiment involves exchanging player cards 170. The method further includes the step of 440, moving by stages—determined by rolling the one or more dice 160 one or more times—at least one game piece 150 from the movement section 130 until one game piece 150 of the at least one game piece 150 reaches and is moved into the finish section 140.

The method may further include the step of 450, rolling two dice 160 on each roll of the dice 160 when determining game piece 150 movement.

The method may further include the step of 460, calculating the score from at least one or more of moving at least one game piece 150 into the finish section 140 and the value indicated by at least one value indicator card 175 associated with the at least one game piece 150.

A general object of the invention is to provide a game board 100 for gameplay that simulates a sports player drafting scenario. One representative rule set of the game includes each game participant, synonymous in this disclosure to the term user, contributing one contract into a pot as a buy-in where a contract is a unit of value such as money and the pot a collection of contracts available to game round winners. The contract, therefore, is a given unit of value. Participants shuffle and deal the forty-four player cards 170 to the game participants wherein each participant has at least four player cards 170. Each game participant may not receive the same amount of player cards 170.

User or users place the eleven game pieces 150 (which may be representative sports figures) at the start row 126 of the start section 125. Four of the game pieces 150 will "BUST" before the combine-simulated workout for sports evaluation-begins. To do this, a first participant rolls the dice 160 and the game piece 150 corresponding to the total on the dice 160 is the first to bust. The game piece 150 is moved one space back (proximally) into the corresponding game piece bust position 123—which in the representative embodiment is four positions deep—of the BUST ZONE (bust section 120). All participants holding a player card 170 displaying an associated game piece number 152 that corresponds to the busted game piece 150 discard that player card 170. For example: if a dice roll pair of three and four is thrown, game piece 150 seven is a bust and moved one game piece movement position 132 behind the start row 126. All game participants holding a player card 170 denoting seven discard that player card 170.

If a number is rolled multiple times during the bust round, then the corresponding game piece 150 continues to move back one to four game piece bust positions 123. Rolling continues until four game pieces 150 are in the bust section 120. The four game pieces 150 will remain in the bust section 120 for an entire round. If, at any time during the round, the number corresponding to a busted game piece 150 is rolled, the game participant will contribute the designated amount of contracts to the pot, escalating from 1× to 4× the number of buy-in contracts, depending on the position to which the game piece 150 moves in the best section. For illustration, if one contract is valued at one dollar for a given game and a bust number for a given game piece 150 is rolled three times, game participants who held the player cards 170 representing that game piece 150 would contribute three contracts (three dollars) to that pot.

The game pieces 150 remaining on the starting row are now ready for the combine to begin. The next participant rolls the dice 160 and the corresponding game piece 150 to the total on the dice 160 moves one game piece movement position 132 forward (distally) toward the finish section 140. However, if the total on the dice 160 corresponds to a busted game piece 150, the game participant must contribute the designated amount of contracts to the pot.

Each participant takes a turn rolling the dice 160 and either moving a game piece 150 forward toward the finish section 140 or contributing contracts to the pot. Play continues until one of the game pieces 150 is moved into the finish row 144 of the finish section 140.

In this illustration of gameplay, participants may negotiate and trade or purchase player cards 170. If more than one participant holds player cards 170 corresponding to the first game piece 150 to be moved into the finish row 144 of the finish section 140, the pot is split evenly among those participants.

Figure 5:
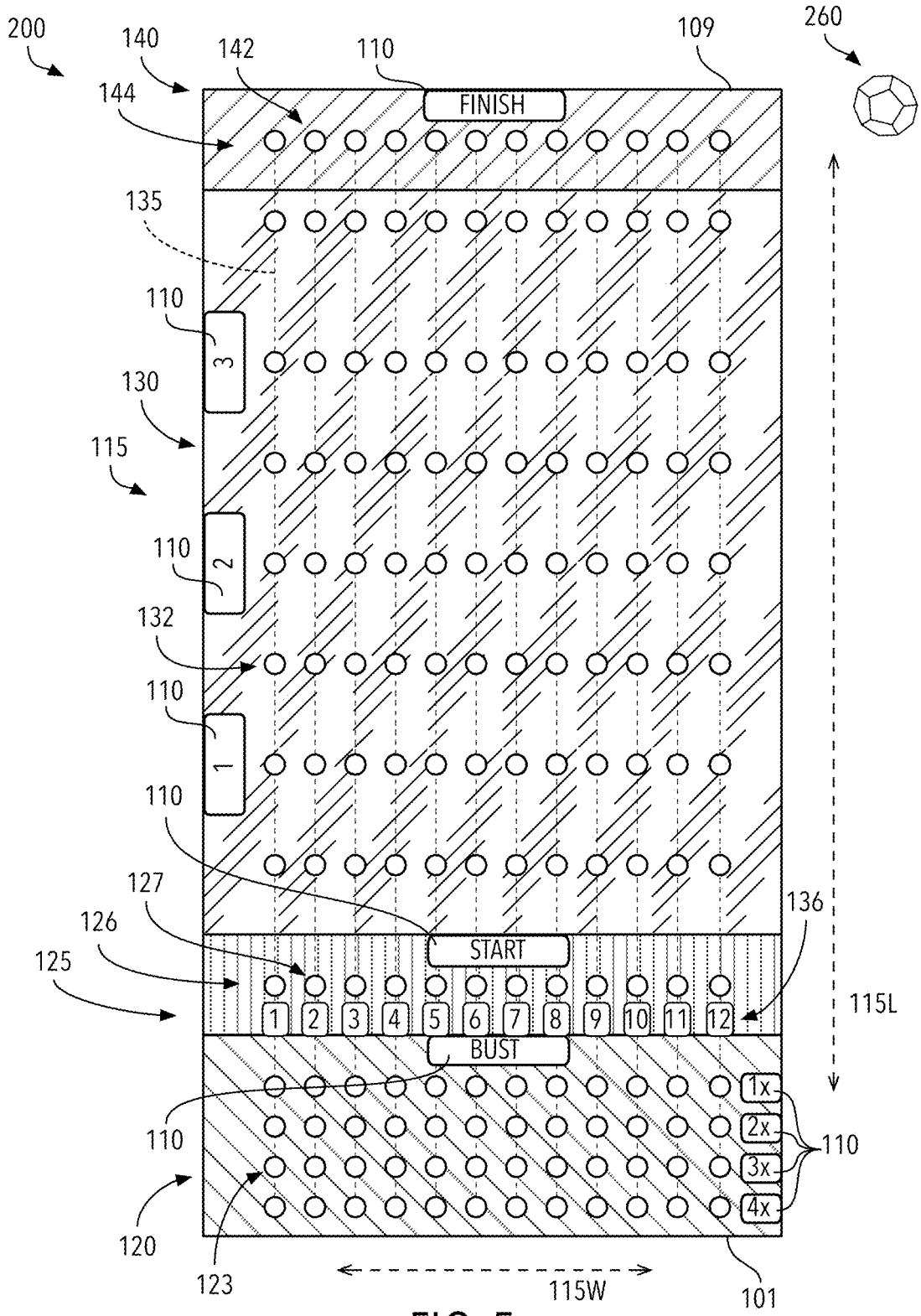

As generally shown in FIG. 5, another object of the invention is to provide a framework for other gameplay variations and another respective gameboard configuration, gameboard 200. Elements, therefore, are modifiable such as the number of game piece movement positions 132 on a given pathway 135. Twelve-sided dice 260 may be used wherein there may be twelve game pieces 150 and forty-eight player cards 170. Four-sided dice may be used wherein there may be ten game pieces 150 and forty player cards 170. Other dice types may be used wherein the maximum number of game pieces (u) is one plus the number of non-ordered combinations(s) possible within the set(S) of total possible rollable numbers less the total number of dice 160 rolled (d) or: $u=(s+1)-d$.

It should be noted that the various indicia and/or game pieces on gameboards 100 and/or 200 may be stylized or configured such that they represent specific sports. For example, the game pieces can take forms of American Football players with helmets and uniforms having respective identifiers thereon, whereas area of play 115 may be configured to have the appearance of an American Football field, e.g., having yard-line markers, an endzone, etc.

Computerized versions of the invention may simulate physical objects virtually, for example, dice simulation programs may substitute for actual dice 160. Virtual reality versions of game elements are used in some embodiments. Augmented reality versions of game elements are used in some embodiments. These variations do not change the underlying invention.

Various related embodiments of the inventive concept are also described in the drawings, which are incorporated herein by reference in their entirety. The following patents and patent applications are incorporated by reference in their entirety:

U.S. Pat. Nos.:
7,232,128, filed May 24, 2005; U.S. Pat. No. 5,318,304, filed Apr. 23, 1993; U.S. Pat. No. 5,163,687, filed Jan. 24, 1992; U.S. Pat. No. 4,027,882, filed Jun. 23, 1976; and, 4,729,568, filed Sep. 9, 1985, U.S. Published Patent Application Nos.:
2009/0039601, filed Aug. 7, 2007; 2007/0013130, filed Jul. 14, 2005; 2007/0013129, filed Jul. 14, 2005; and, 2006/0261551, filed May 23, 2005.

United Kingdom Patent Reference No.:
GB2051590, filed Jul. 11, 1980.

While inventive concepts have been described above in terms of specific embodiments, it is to be understood that the inventive concepts are not limited to these disclosed embodiments. Upon reading the teachings of this disclosure, many modifications and other embodiments of the inventive concepts will come to mind of those skilled in the art to which these inventive concepts pertain, and which are intended to be and are covered by both this disclosure and the appended claims. It is indeed intended that the scope of the inventive concepts should be determined by proper interpretation and construction of the appended claims and their legal equivalents, as understood by those of skill in the art relying upon the disclosure in this specification and the attached drawings.

REPRESENTATIVE COMPONENTS

100 Game board
101 Proximal end of the game board
109 Distal end of the game board
110 Indicia
115 Area of play
115W Width of the area of play
115L Length of the area of play
120 Bust section
123 Game piece bust position
125 Start section
126 Start row
127 Game piece start position
130 Movement section
132 Game piece movement position
135 Pathways
136 Pathway number
140 Finish section
142 Game piece finish position
144 Finish row
146 Roll box
150 Game piece
150P Peg
152 Game piece number
160 Dice
170 Player card
172 Player card number
175 Value indicator card
200 Gameboard
260 12-side dice

What is claimed is:

1. A board game, comprising:

a game board having a proximal end and a distal end, the game board having indicia, the indicia representing an area of play having a length and a width and indicating sections including:

a bust section at the proximal end of the game board, the bust section having a plurality of game piece bust positions arranged in at least one bust row, the at least one bust row substantially the width of the area of play;

a start section adjacent to the bust section having a plurality of game piece start positions arranged in a start row, the start row substantially the width of the area of play;

a finish section arranged at the distal end of the game board and having a plurality of game piece finish positions arranged in a finish row, the finish row substantially the width of the area of play;

a movement section arranged between and adjacent to the start section and the finish section having a plurality of game piece movement positions, the plurality of game piece movement positions arranged on a plurality of pathways along the length of the area of play, each of the plurality of pathways having a pathway number and one or more game piece movement positions; and a plurality of game pieces adapted to be moved on the area of play, movement at least partially determined by one or more dice, each game piece of the plurality of game pieces associated with a game piece number equal to and representing a pathway number that can appear on a roll of the one or more dice, wherein each game piece number corresponds to a player card having a player card number equal to and representing the game piece number.

2. The game board recited in claim 1, wherein the bust section, the start section, the movement section, and the finish section each have a different color from adjacent sections.

3. The game board recited in claim 1, wherein the number of game piece movement positions on each pathway of the plurality of pathways is determined by the probability of rolling the pathway number on the one or more dice.

4. The game board recited in claim 1, further comprising two six-sided dice.

5. The game board recited in claim 1, wherein at least the indicia and the game pieces are presented and controllable on at least one computer interface of at least one computer.

6. The game board recited in claim 1, wherein at least the indicia and the game pieces are presented as physical elements of at least one or more from a group comprising of cellulose materials, polymer materials, metallic materials, and ceramic materials.

7. The game board recited in claim 6, wherein the game pieces are pegs.

8. A board game, comprising:

a game board having a proximal end and a distal end, the game board having indicia, the indicia representing an area of play having a length and a width and indicating sections including:

a bust section at the proximal end of the game board, the bust section having eleven game piece bust positions arranged in four bust rows, the four bust rows substantially the width of the area of play;

a start section adjacent to the bust section having eleven game piece start positions arranged in a start row, the start row substantially the width of the area of play;

a finish section arranged at the distal end of the game board and having eleven game piece finish positions arranged in a finish row, the finish row substantially the width of the area of play;

a movement section arranged between and adjacent to the start section and the finish section having a plurality of game piece movement positions, the plurality of game piece movement positions arranged on eleven pathways along the length of the area of play, each of the eleven pathways having a pathway number from two to twelve sequentially and one or more game piece movement positions disposed on each pathway of the eleven pathways; and eleven game pieces adapted to be moved on the area of play, movement at least partially determined by two dice, the dice adapted to be rolled together, each game piece of eleven game pieces associated with a game piece number from two to twelve representing a pathway number that can appear on a roll of the two dice.

9. The game board recited in claim 8, wherein:

pathway two and twelve each have one game piece movement position, pathway three and eleven each have two game piece movement positions, pathway four and ten each have three game piece movement positions, pathway five and nine each have four game piece movement positions, pathway six and eight each have six game piece movement positions, and pathway seven has seven game piece movement positions.

10. The game board recited in claim 8, wherein each game piece number corresponds to a player card having a player card number equal to and representing the game piece number.

11. The game board recited in claim 10, wherein there are forty-four of the player cards, four of the player cards for each game piece.

12. The game board recited in claim 8, further comprising eleven value indicator cards for each game board user.

13. The game board recited in claim 8, wherein the bust section, the start section, the movement section, and the finish section each have a different color from adjacent sections.

14. The game board recited in claim 8, wherein at least the indicia and the game pieces are presented and controllable on at least one computer interface of at least one computer.

15. The game board recited in claim 8, wherein at least the indicia and the game pieces are presented as physical elements of at least one or more from a group comprising of cellulose materials, polymer materials, metallic materials, and ceramic materials.

16. The game board recited in claim 15, wherein, the game pieces are pegs.

17. A board game method, comprising:

placing game pieces of a plurality of game pieces by users on a starting row of a start section the width of a playing area of a game board wherein each game piece of the plurality of game pieces is aligned with a pathway of a movement section adjacent to the start section, each pathway along the length of the playing area and having a pathway number, each game piece given a game piece number equal to the pathway number aligned with that game piece on the starting row;

rolling the one or more dice one or more times to determine each game piece of the plurality of game pieces that will move proximally from the starting row to a bust section adjacent to the start section, and then moving those game pieces;

rolling the one or more dice one or more times to determine each game piece of the plurality of game pieces will move distally from the starting row into a movement section and toward a finish section adjacent to the movement section, and then moving those game pieces;

exchanging, in a time period between rolling dice, one or more game piece numbers between users; and moving by stages, determined by rolling the one or more dice one or more times, at least one game piece from the movement section until one game piece of the at least one game pieces reaches and is moved into the finish section.

18. The board game method of claim 17, further comprising rolling two dice on each roll of the dice when determining game piece movement.

19. The board game method of claim 17, further comprising calculating a score from at least one or more of moving at least one game piece into the finish section and a value indicated by at least one value indicator card associated with the at least one game piece.

* * * * *